US006296522B1

(12) United States Patent
Ho

(10) Patent No.: US 6,296,522 B1
(45) Date of Patent: Oct. 2, 2001

(54) ELECTRICAL SOCKET

(75) Inventor: Hsien-Wen Ho, Tainan (TW)

(73) Assignee: Chi-Wen Chen, Taipei (TW)

( * ) Notice: Subject to any disclaimer, the term of this patent is extended or adjusted under 35 U.S.C. 154(b) by 0 days.

(21) Appl. No.: 09/716,552

(22) Filed: Nov. 20, 2000

(51) Int. Cl.[7] ..... H01R 25/00
(52) U.S. Cl. ..... 439/640; 439/654
(58) Field of Search ..... 439/502, 505, 439/21, 27, 535, 640, 650, 654

(56) References Cited

U.S. PATENT DOCUMENTS 6,179,665 * 1/2001 Rossman et al. ..... 439/654
6,200,159 * 3/2001 Chou ..... 439/535

* cited by examiner

*Primary Examiner*—Khiem Nguyen
(74) *Attorney, Agent, or Firm*—Ohlandt, Greeley, Ruggiero & Perle, L.L.P.

(57) ABSTRACT

An electrical socket includes a pair of coupled insulative housings, a conductor set mounted in one of the housings, a conductive contact member set including a pair of spaced apart contact members that are selectively mounted in one of the housings, and a conductive resilient member set including a pair of spaced apart spring members that are selectively mounted in the other one of the housings, and that respectively and resiliently bridge the contact members. At least one of the resilient member set and the contact member set is rotatable relative to the other one of the resilient member set and the contact member set.

19 Claims, 11 Drawing Sheets

ELECTRICAL SOCKET

BACKGROUND OF THE INVENTION

1. Field of the Invention

This invention relates to an electrical socket, more particularly to an electrical socket having a plurality of receptacle units that are coupled together and that are independently rotatable relative to each other.

2. Description of the Related Art

FIG. 1 illustrates a conventional electrical socket 1 that can be mounted on a stake 10 for outdoor use. The electrical socket 1 includes a housing that is composed of two housing halves which are coupled together, and three receptacle units 12 that are mounted in the housing and that respectively have outlets 121 aligned along a length of the housing for receiving power plugs. A switch 13 is mounted on the housing, and is electrically connected to the receptacle units 12 and an electric wire 14. A bottom opening 112 is formed in the housing. The stake 1 includes a cone-shaped body 101 and an engaging flange 102 which projects from a top end of the cone-shaped body 101 through the bottom opening 112 and into the housing to engage a periphery of the bottom opening 112.

Since the outlet 121 in the receptacle units 12 are disposed along a line, it is relatively inconvenient to plug different power plugs that come from different directions. Moreover, the periphery of each outlet 121 tends to accumulate dirt after being in use for a period of time.

SUMMARY OF THE INVENTION

Therefore, it is an object of the present invention to provide an electrical socket that is capable of overcoming the drawbacks described above.

Accordingly, an electrical socket of this invention comprises: a pair of insulative housings coupled together, at least one of the housings being turnable relative to the other one of the housings about an axis, one of the housings being formed with a socket outlet that is adapted to receive a power plug; a conductor set including a pair of spaced apart conductors that are mounted in one of the housings and that are adapted to connect electrically with the power plug; a conductive contact member set including a pair of spaced apart contact members that are selectively mounted in one of the housings; and a conductive resilient member set including a pair of spaced apart spring members that are selectively mounted in the other one of the housings, and that respectively and resiliently bridge the contact members, at least one of the resilient member set and the contact member set being rotatable relative to the other one of the resilient member set and the contact member set about the axis with the spring members respectively and resiliently in sliding contact with the contact members when the associated one of the housings rotate relative to the other one of the housings about the axis.

BRIEF DESCRIPTION OF THE DRAWINGS

In drawings which illustrate embodiments of the invention.

DETAILED DESCRIPTION OF THE PREFERRED EMBODIMENTS

Figure 1:
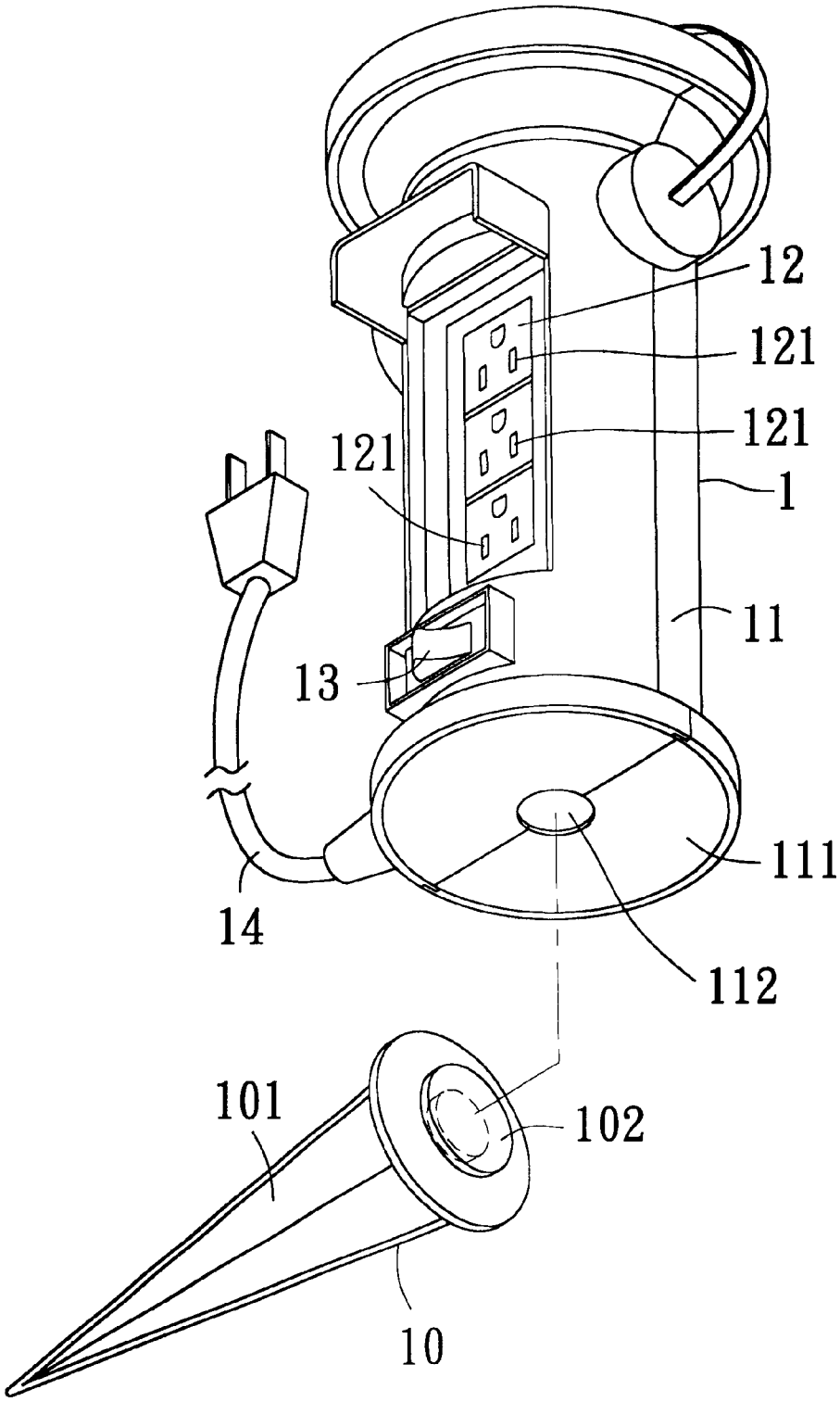
FIG. 1 PRIOR ART
FIG. 1 is a perspective view of a conventional electrical socket.
Figure 2:
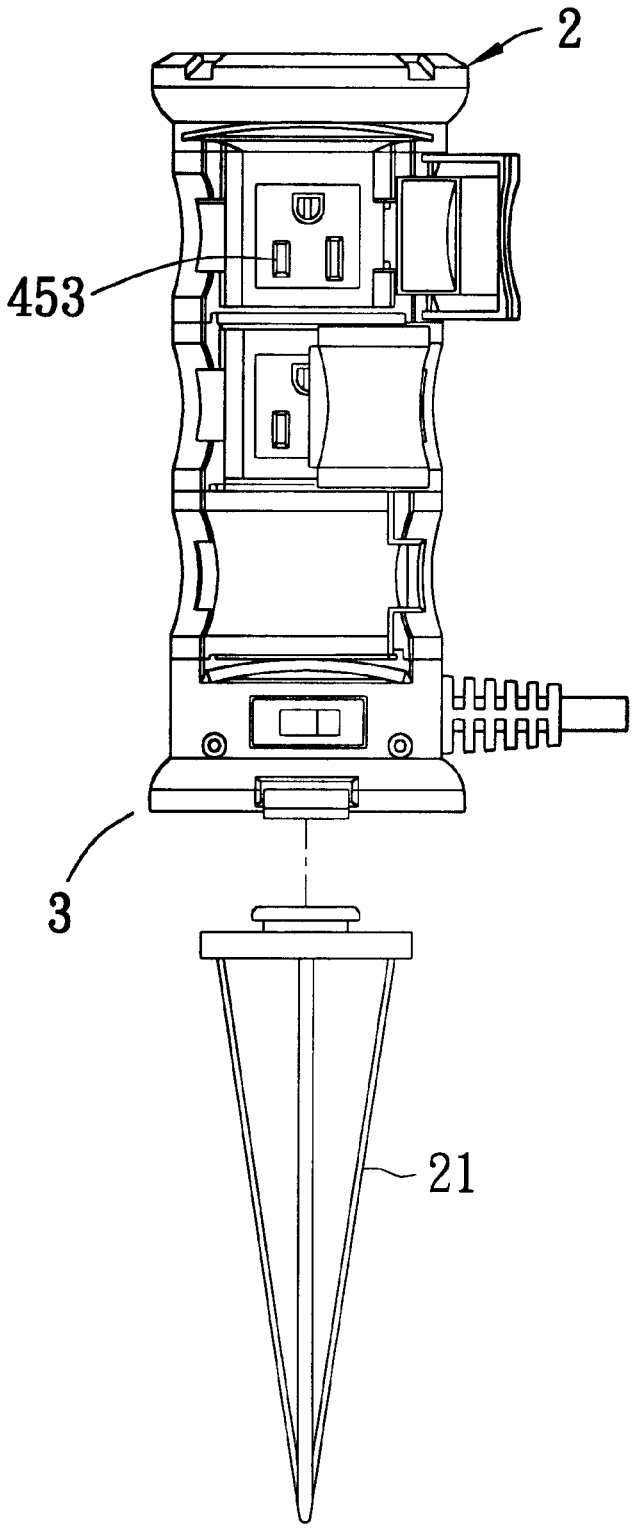
FIG. 2 is a front view to illustrate a preferred embodiment of an electrical socket according to this invention for mounting on a stake.
Figure 3:
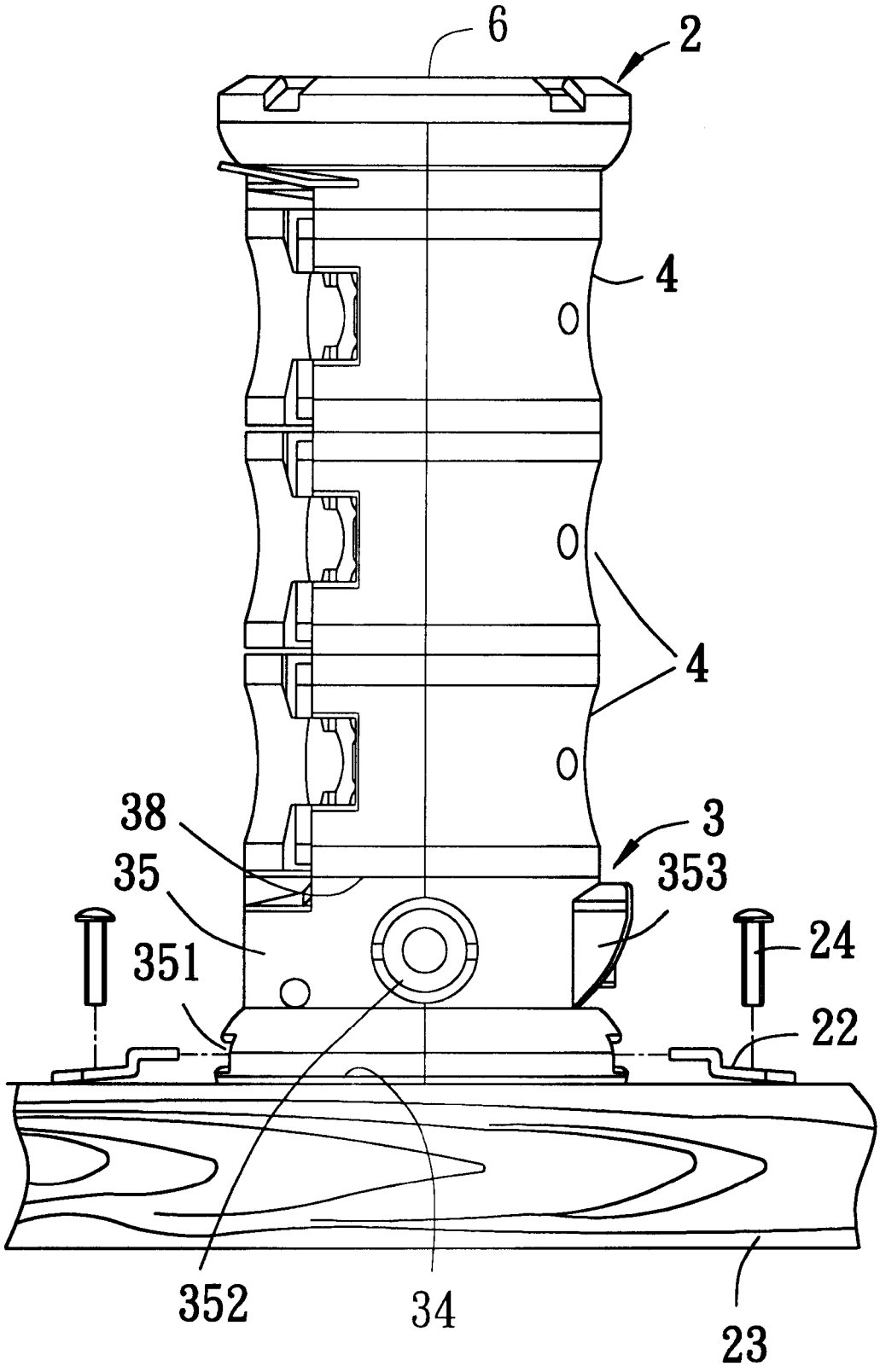
FIG. 3 is another front view to illustrate the electrical socket of FIG. 2 for mounting on a wooden board.

FIGS. 2 and 3 illustrate a preferred embodiment of an electrical socket 2 according to this invention. The electrical socket 2 includes a base unit 3 which can be mounted on a stake 21 in a conventional manner or on a wooden board 23 via a pair of lug plates 22 inserted into two opposite bottom retaining holes 351 in the base unit 3. The lug plates 22 have extensions fastened to the wooden board 23 via screw means 24.

The electrical socket 2 further includes a plurality of receptacle units 4 that are coupled together in a series with a bottommost one mounted on the base unit 3, and an insulative overhead 6 mounted on a topmost one of the receptacle units 4.

Figure 4:
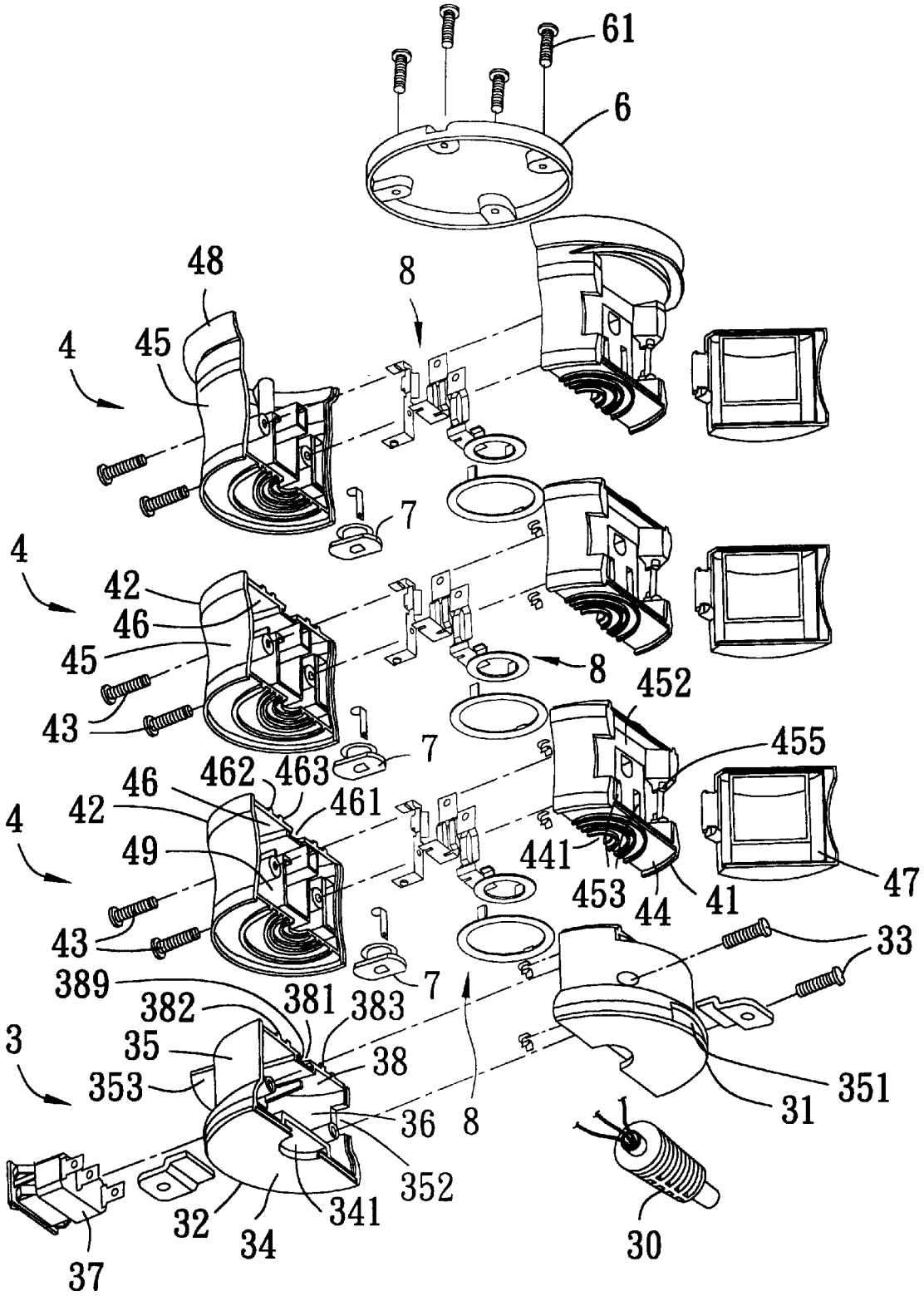
FIG. 4 is an exploded perspective view of the electrical socket of FIG. 2.
Figure 5:
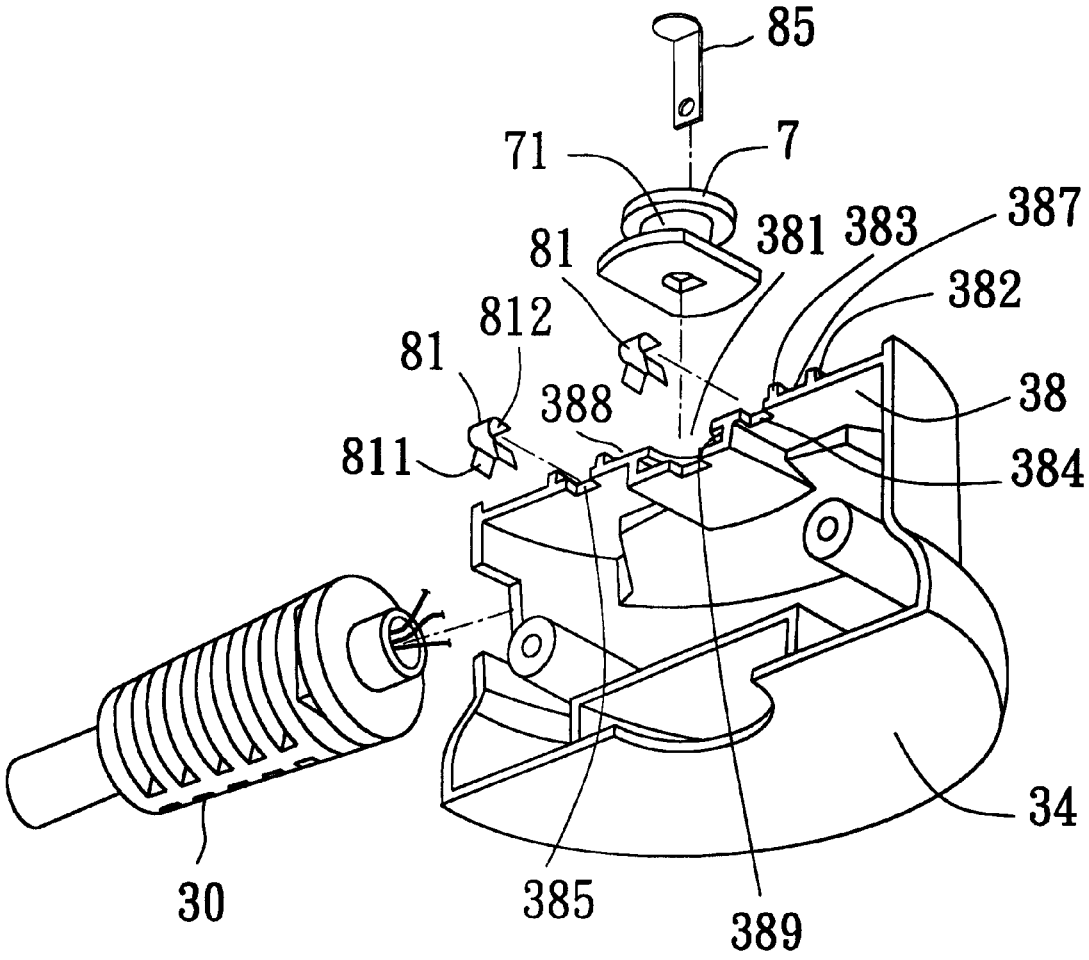
FIG. 5 is a fragmentary exploded view to illustrate a ground connecting member, a pivot member and a pair of spring members mounted on a base of the electrical socket of FIG. 2.

With further reference to FIGS. 4 and 5, the base unit 3 includes an insulative housing that is composed of a pair of housing halves 31, 32 which are coupled together via screw means 33 to confine a base inner space 36 therebetween, top and bottom walls 38, 34, and a peripheral side wall 35 interconnecting the top and bottom walls 38, 34. A bottom retaining slot 341 is formed in the bottom wall 34 for engaging a top end of the stake 21 (see FIG. 2). The peripheral side wall 35 is formed with a hole 352 for passage of an electric wire 30. A switch 37 is mounted on the peripheral side wall 35, and is connected to the electric wire 30. A shade 353 project outwardly from the peripheral side wall 35 for preventing the switch 37 from being dampened by rain. The top wall 38 is formed with a top opening 381 and a top retaining slot 389 that is disposed underneath and that communicates with the top opening 381. A pair of radially spaced apart inner and outer annular flanges 383, 382 project upwardly from the top wall 38, and surround the top opening 381.

Figure 6:
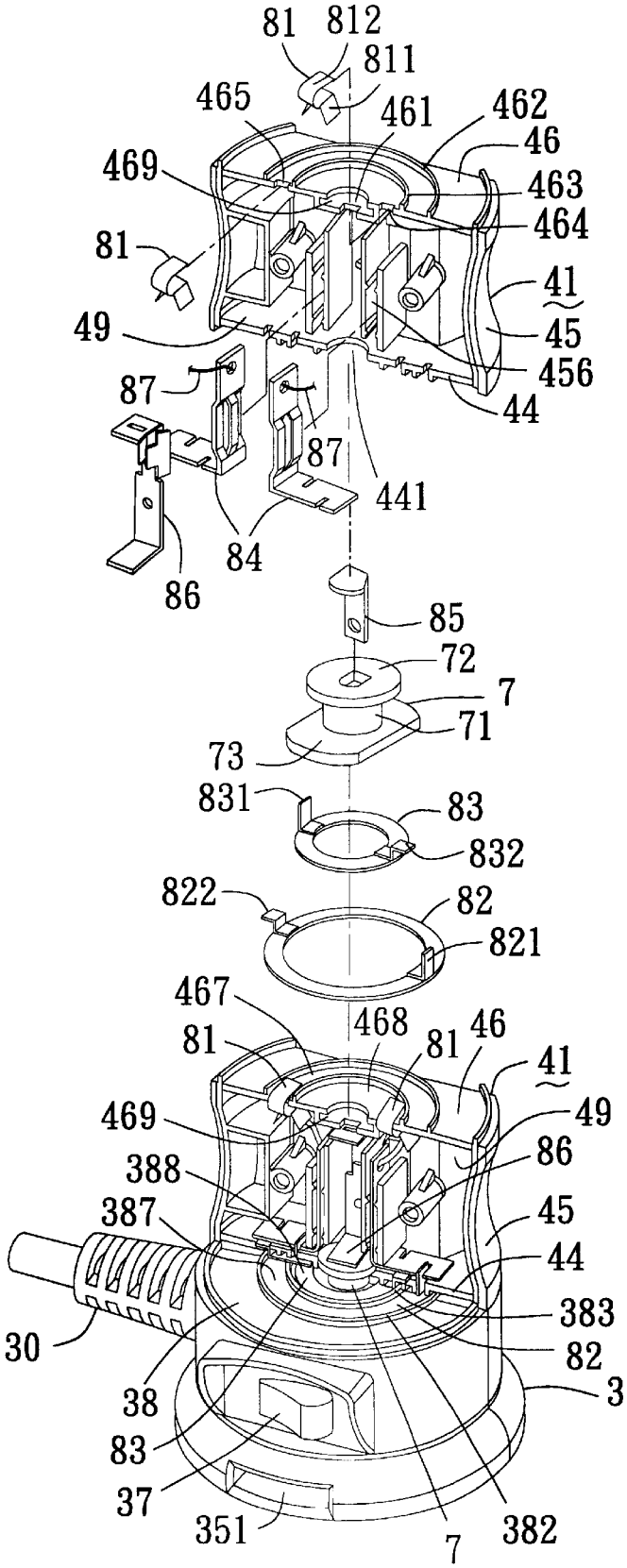
FIG. 6 is a fragmentary exploded perspective view to illustrate two adjacent receptacle units of the electrical socket of FIG. 2.

Referring to FIGS. 4 and 6, each receptacle unit 4 includes an insulative housing that is composed of a pair of housing halves 41, 42 which are coupled together via screw means 43 to confine an inner space 49 therebetween, top and bottom walls 46, 44, and a peripheral side wall 45 interconnecting the top and bottom walls 46, 44. A bottom opening 441 and a top opening 461 are respectively formed in the bottom wall 44 and the top wall 46 of each receptacle unit 4. The top and bottom openings 461, 441 in the receptacle units 4 and the top opening 381 in the base unit 3 are vertically aligned. The top wall 46 of each receptacle unit 4 has a configuration similar to the top wall 38 of the base unit 3, and is formed with a top retaining slot 469 which is disposed underneath and which is communicated with the top opening 461 in the same top wall 46. A pair of radially spaced apart inner and outer annular flanges 463, 462 project upwardly from the top wall 46, and surround the top opening 461 in each receptacle unit 4. The peripheral side wall 45 of each receptacle unit 4 has a recessed face 452, and a hinge 455 adjacent to the recessed face 452. Each receptacle unit 4 has an outlet 453 that opens at the respective recessed face 452 and that is adapted to receive a power plug (not shown) A cover 47 is pivoted on the hinge 455 for covering the recessed face 452 and thus the outlet 453 in each receptacle unit 4 so as to prevent each receptacle unit 4 from being dampened by rain. A pair of conductor positioning slots 456 are formed in the housing of each receptacle unit 4. The housing of the topmost one of the receptacle units 4 has a rim 48 projecting from the top wall 46. The overhead 6 is mounted on and is secured to the rim 48 of the topmost one of the receptacle units 4 via screw means 61.

A plurality of insulative axially extending pivot members 7 are respectively disposed between the base unit 3 and the bottommost one of the receptacle units 4, and between each two adjacent ones of the receptacle units 4. Each pivot member 7 has an axially extending hollow shaft 71 that defines an axial axis and that has opposite flanged ends 72, 73 extending laterally therefrom in transverse directions relative to the axial axis. The base unit 3 and the bottommost one of the receptacle units 4 are pivoted on the shaft 71 of the respective pivot member 7 which extends through the top opening 381 in the base unit 3 and the bottom opening 441 in the bottommost one of the receptacle units 4. Each two adjacent ones of the receptacle units 4 are pivoted on the shaft 71 of the respective pivot member 7 which extends through the top opening 461 of one of the two adjacent ones of the receptacle units 4 and the bottom opening 441 of the other one of the receptacle units 4. The flanged ends 73, 72 of a bottommost one of the pivot members 7 respectively extend into the top retaining slot 389 in the base unit 3 and the inner space 49 of the bottommost one of the receptacle units 4. The flanged ends 73, 72 of each pivot member 7, which are associated with each two adjacent ones of the receptacle units 4, respectively extend into the top retaining slot 469 in one of the adjacent receptacle units 4 and the inner space 49 in the other one of the adjacent receptacle units 4. The base unit 3 and the receptacle units 4 are independently turnable about the shafts 71 of their respective pivot members 7.

The inner and outer annular flanges 383, 382 of the base unit 3 cooperate with the top wall 38 of the base unit 3 to define an outer annular groove 387 thereamong. The inner annular flange 383 of the base unit 3 and the shaft 71 of the respective pivot member 7 cooperate with the top wall 38 of the base unit 3 to define an inner annular groove 388 thereamong. An outer retaining hole 385 is formed in the top wall 38 of the base unit 3 between the inner and outer annular flanges 383, 382 of the base unit 3, and is communicated with the outer annular groove 387. An inner retaining hole 384 is formed in the top wall 38 of the base unit 3 between the inner annular flange 383 and the shaft 71 of the respective pivot member 7, and is communicated with the inner annular groove 388.

The inner and outer annular flanges 463, 462 of each receptacle unit 4 cooperate with the top wall 46 of the receptacle unit 4 to define an outer annular groove 467 thereamong. The inner annular flange 463 of each receptacle unit 4 and the shaft 71 of the respective pivot member 7 cooperate with the top wall 46 of the receptacle unit 4 to define an inner annular groove 468 threamong. An outer retaining hole 465 is formed in the top wall 46 of each receptacle unit 4 between the inner and outer annular flanges 463, 462 of the receptacle unit 4. An inner retaining hole 464 is formed in the top wall 46 of each receptacle unit 4 between the inner annular flange 463 of the receptacle unit 4 and the shaft 71 of the respective pivot member 7.

Each receptacle unit 4 further includes a conductor set mounted in the housing thereof, a conductive contact member set associated with the conductor set, and a conductive resilient member set associated with the contact member set and mounted on the top wall 46 thereof. An additional resilient member set is mounted on the top wall 38 of the base unit 3.

Figure 8:
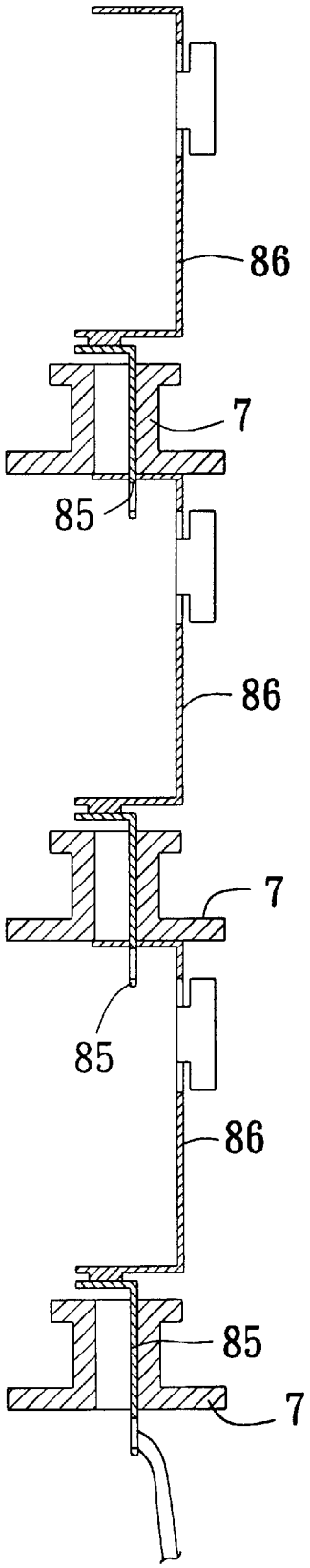
FIG. 8 is a cross-sectional side view to illustrate connections of ground conductors of the receptacle units of the electrical socket of FIG. 2.

The conductor set of each receptacle unit 4 includes a pair of L-shaped first and second conductors 84 respectively mounted in the conductor positioning slots 456 in the receptacle unit 4, and a U-shaped ground conductor 86 mounted in the receptacle unit 4. An L-shaped ground connecting member 85 is mounted in and extends through the shaft 71 of each pivot member 7. Each ground conductor 86 interconnects two adjacent ones of the ground connecting members 85 so that all of the ground conductors 86 are electrically connected (see FIG. 8). Each of the first and second conductors 84 has an axially extending portion 842 received in the respective conductor positioning slot 456, and a laterally extending portion 841 extending from the axially extending portion 842 in the transverse direction relative to the axis.

Each contact member set includes a pair of spaced apart contact members respectively having annular plate portions 83, 82, connecting portions 831, 821 projecting from one side of the annular plate portions 83, 82, and positioning portions 832, 831 projecting from the other side of the annular plate portions 83, 82. The connecting portions 821, 831 of the contact members are respectively connected to the laterally extending portions 841 of the first and second conductors 84 of the respective conductor set (see FIGS. 6 and 7). The annular plate portions 83, 82 of the contact members of the bottommost one of the receptacle unit 4 are respectively received in the inner and outer annular grooves 388, 387 of the base unit 3. For each two adjacent ones of the receptacle units 4, the annular plate portions 83, 82 of the contact member of one of the adjacent receptacle units 4 are respectively received in the inner and outer annular grooves 468, 467 of the other one of the adjacent receptacle units 4.

Figure 9:
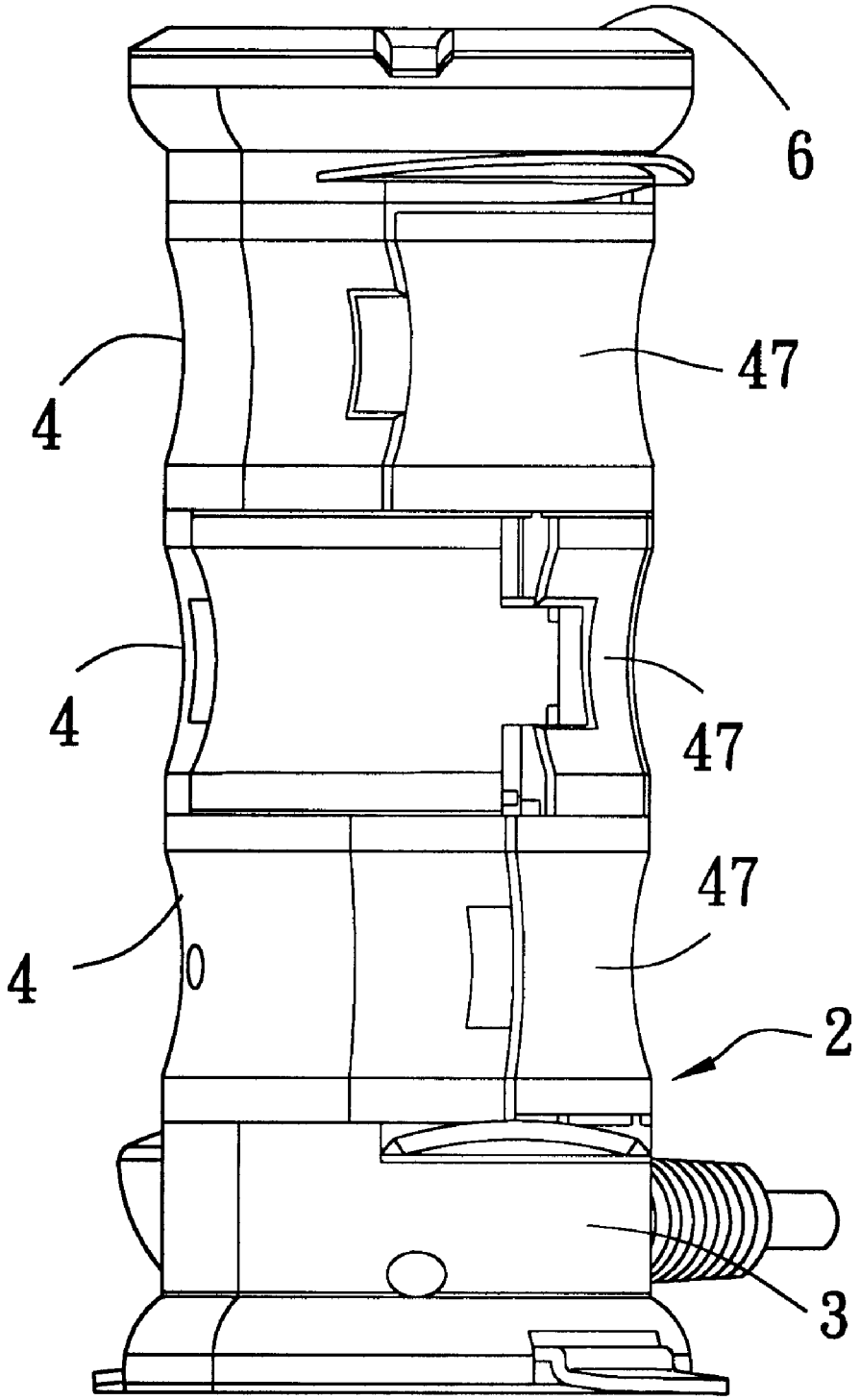
FIG. 9 is a side view to illustrate positions of the receptacle units after being independently turned relative to each other.

The resilient member set of each receptacle unit 4 includes a pair of spaced apart spring members 81 respectively mounted in the inner and outer retaining holes 464, 465 in the receptacle unit 4. The resilient member set of the base unit 3 is similar to those of the receptacle units 4, and includes a pair of spaced apart spring members 81 respectively mounted in the inner and outer retaining holes 384, 385 in the base unit 3. The spring members 81 of each receptacle unit 4 respectively have spring arms 812 that resiliently bridge the annular plate portions 82, 83 of the contact members of an adjacent one of the receptacle units 4 such that the spring arms 812 of the resilient member set of each receptacle unit 4 are resiliently and slidingly in contact with the annular plate portions 82, 83 of the contact member set of an adjacent one of the receptacle units 4, thereby permitting each two adjacent ones of the receptacle units 4 to turn independently about the shaft 71 of the respective pivot member 7. Similarly, the spring members 81 of the resilient member set of the base unit 3 respectively have spring arms 812 that resiliently bridge the annular plate portions 82, 83 of the contact members of the bottommost one of the receptacle units 4, thereby permitting the bottommost one of the receptacle units 4 to turn about the shaft 71 of the respective pivot member 7 relative to the base unit 3. FIG. 3 illustrates the outlets 453 of the receptacle units 4 when they are vertically aligned, i.e. open in the same direction. FIG. 9 illustrates the outlets 453 of the receptacle units 4 when the latter are turned to positions such that they open at different directions.

Figure 7:
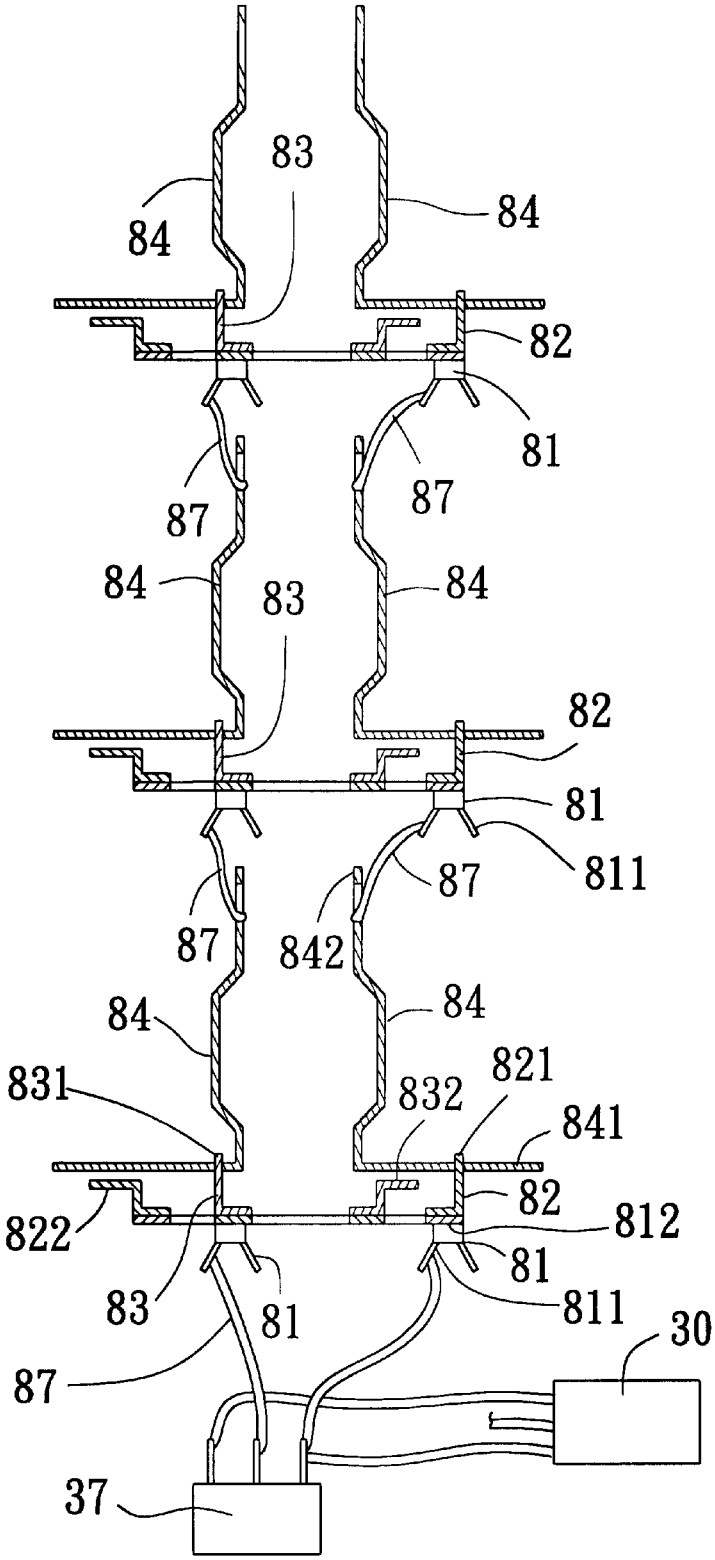
FIG. 7 is a cross-sectional side view to illustrate connections of conductors of the receptacle units of the electrical socket of FIG. 2.

Each one of the spring members 81 of each receptacle unit 4 further has a pair of legs 811 flared downwardly from the spring arm 812 of the spring member 81 and connected to the axially extending portion 842 of the respective conductor 84 via a conductive wire 87 so that all of the first and second conductors 84 of the receptacle units 4 are electrically connected (see FIG. 7). Similarly, each of the spring members 81 of the base unit 3 further has a pair of legs 811 flared downwardly from the spring arm 812 of the spring member 81 and connected to the switch 37 via the conductive wire 87.

Figure 10:
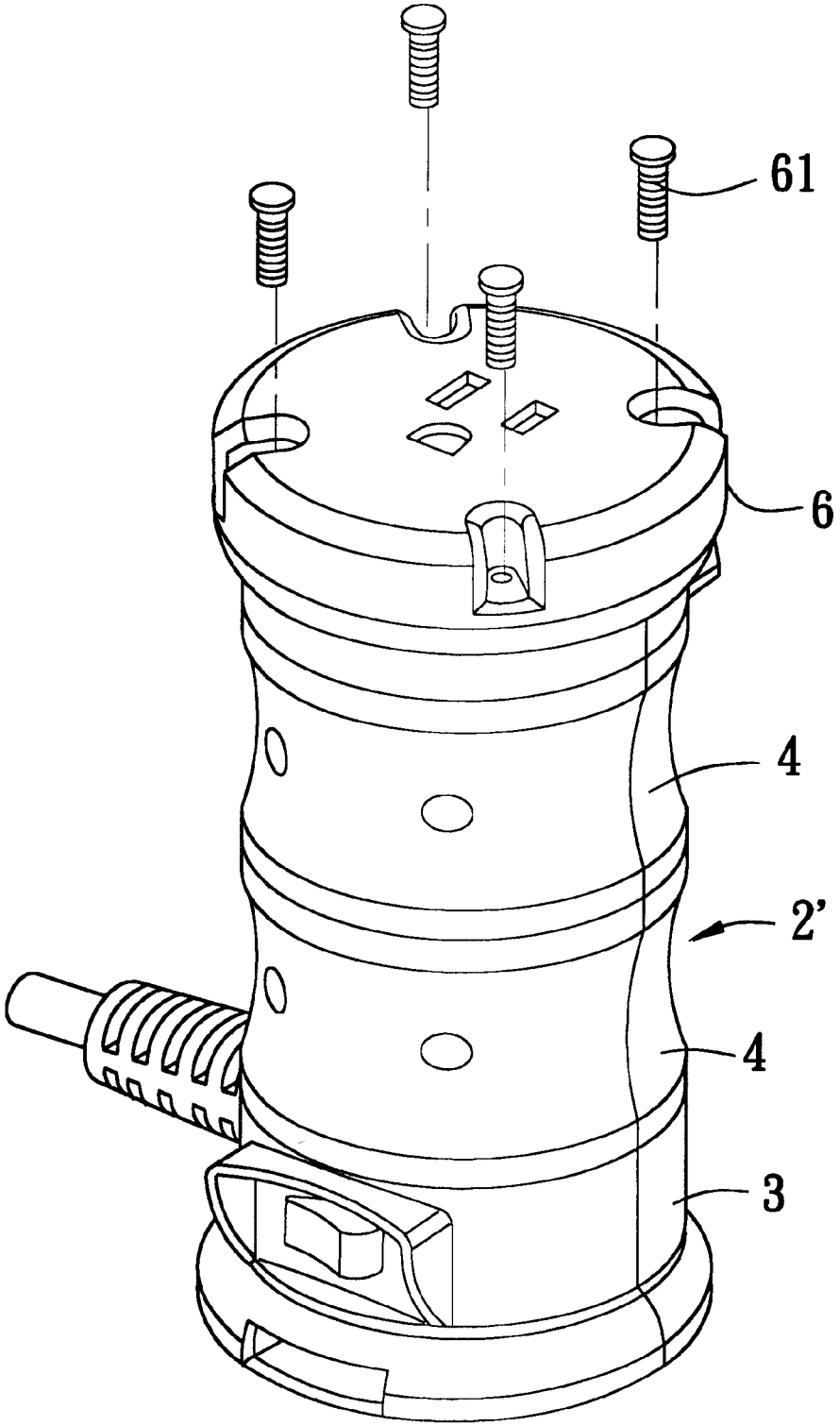
FIG. 10 is a perspective view to illustrate a modified embodiment of the electrical socket of FIG. 2.
Figure 11:
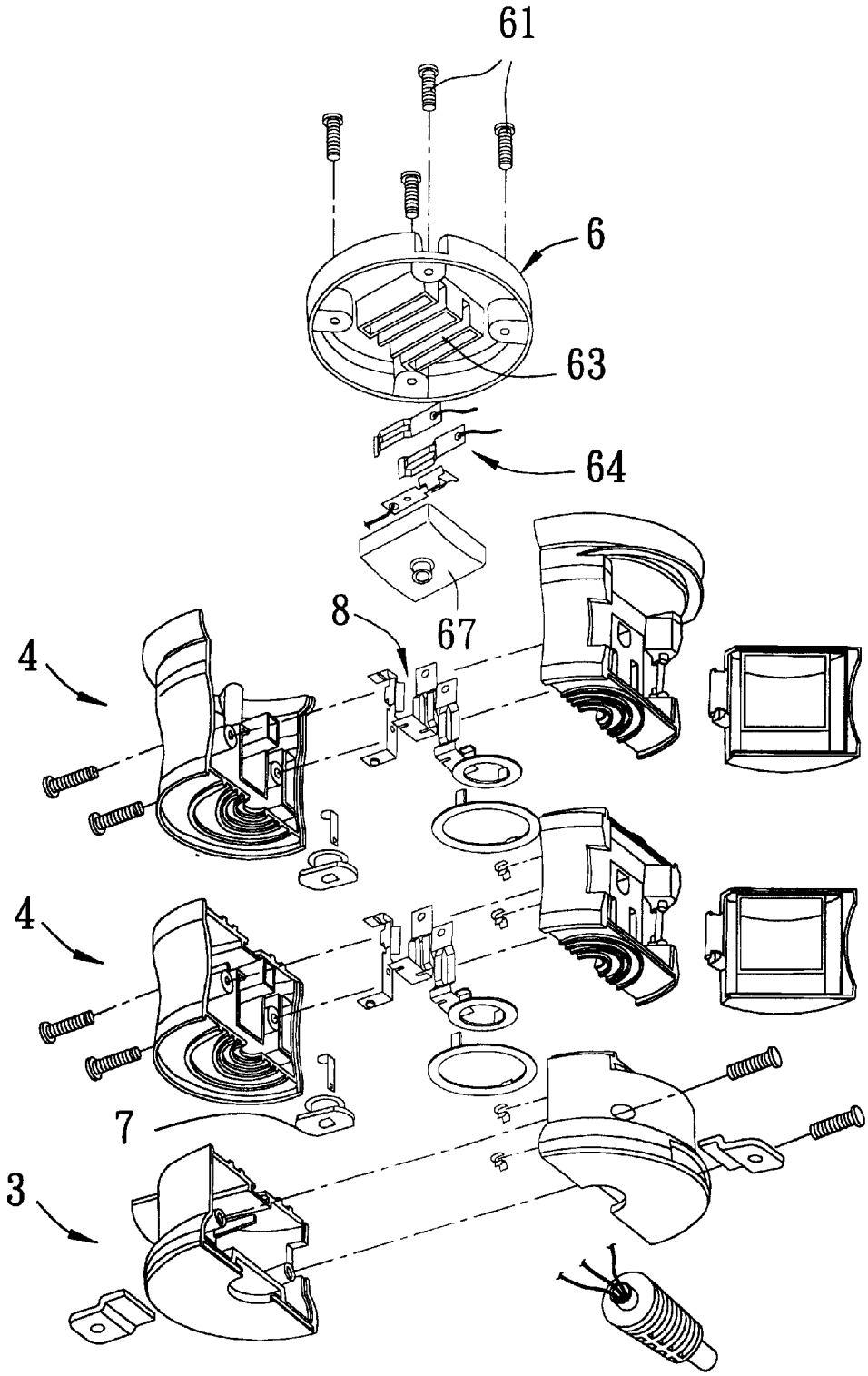
FIG. 11 is an exploded view of the electrical socket of FIG. 10.

FIGS. 10 and 11 illustrate a modified electrical socket 2' of FIG. 2. The electrical socket 2' is similar to the previous electrical socket 2 except that the overhead 6 is modified to hold an additional conductor set 64, and serves as a receptacle. A positioning seat 63 projects from the overhead 6 into the housing of the topmost one of the receptacle units 4 for holding the conductor set 64. An insulative retaining member 67 is mounted on a bottom of the positioning seat 63 for preventing the conductor set 64 from falling.

With the contact member set and the resilient member set in each receptacle unit 4, the aforementioned inconvenience as encountered in the prior art can be eliminated.

With the invention thus explained, it is apparent that various modifications and variations can be made without departing from the spirit of the present invention. It is therefore intended that the invention be limited only as recited in the appended claims.

I claim:

1. An electrical socket comprising:

a pair of insulative housings coupled together, at least one of said housings being turnable relative to the other one of said housings about an axis, one of said housings being formed with an outlet that is adapted to receive a power plug;

a first conductor set including a pair of spaced apart conductors that are mounted in said one of said housings and that are adapted to connect electrically with the power plug;

a conductive contact member set including a pair of spaced apart contact members that are selectively mounted in one of said housings; and a conductive resilient member set including a pair of spaced apart spring members that are selectively mounted in the other one of said housings, and that respectively and resiliently bridge said contact members, at least one of said resilient member set and said contact member set being rotatable relative to the other one of said resilient member set and said contact member set about said axis with said spring members respectively and resiliently in sliding contact with said contact members when the associated one of said housings rotate relative to the other one of said housings about said axis, said conductors being selectively connected to one of said contact member set and said resilient member set.

2. The electrical socket of claim 1, further comprising an axially extending pivot member disposed between said housings which are pivoted thereto, said pivot member having a shaft that defines said axis.

3. The electrical socket of claim 1, wherein each of said contact members has a curved plate portion extending circumferentially and turnable about said axis.

4. The electrical socket of claim 1, wherein said contact members respectively have annular plate portions that are radially spaced apart and that are turnable about said axis.

5. The electrical socket of claim 1, wherein each of said spring members has a flat spring arm that projects to and that abuts resilient against the respective one of said contact members.

6. The electrical socket of claim 1, wherein said contact members are respectively connected to said conductors in said one of said housings, said spring members being mounted on said other one of said housings.

7. The electrical socket of claim 6, wherein said contact members respectively have annular plate portions that are radially spaced apart and that are turnable about said axis, and connecting portions that respectively project from said annular plate portions in transverse directions relative to said annular plate portions to respectively connect with said conductors in said one of said housings.

8. The electrical socket of claim 7, wherein said one of said housings has a bottom wall, said connecting portions of said contact members extending through said bottom wall from said annular plate portions to said conductors in said one of said housings.

9. The electrical socket of claim 8, wherein said other one of said housings has a top wall facing said bottom wall of said one of said housings, said spring members being mounted on said top wall, and having flat spring arms that respectively project therefrom to said annular plate portions of said contact members to abut resiliently against said annular plate portions.

10. The electrical socket of claim 9, further comprising an axially extending pivot member disposed between said housings which are pivoted thereto and which are independently rotatable about said pivot member, said pivot member having a shaft that defines said axis.

11. The electrical socket of claim 10, wherein said top wall of said other one of said housings has a top opening and a retaining slot underneath and communicating with said top opening, said bottom wall of said one of said housings having a bottom opening aligned with said top opening, said shaft of said pivot member having two opposite ends respectively and axially extending through said top and bottom openings, said shaft having a bottom flanged end extending in a transverse direction relative to said axis into said retaining slot in said top wall of said other one of said housings.

12. The electrical socket of claim 11, wherein said top wall of said other one of said housings has inner and outer annular flanges projecting from said top wall toward said bottom wall of said one of said housings and surrounding said shaft of said pivot member, said inner and outer annular flanges being radially spaced apart and cooperating with said top wall of said other one of said housings to define an outer annular groove, said inner annular flange and said shaft cooperating with said top wall of said other one of said housing to define an inner annular groove, said annular plate portions of said contact members being respectively received in said inner and outer annular grooves, said spring arms of said spring members respectively projecting into said inner and outer grooves to slidingly and respectively contact said annular plate portions.

13. The electrical socket of claim 12, wherein said top wall of said other one of said housings further has an outer retaining hole formed between said inner and outer flanges, and an inner retaining hole formed between said inner flange and said shaft of said pivot member, said spring members being respectively mounted in said inner and outer retaining holes.

14. The electrical socket of claim 13, wherein each of said spring members further has a pair of flat legs flared downwardly from the respective one of said spring arms through the respective one of said inner and outer retaining holes and into said other one of said housings.

15. The electrical socket of claim 14, wherein said other one of said housings is formed with a socket outlet, said electrical socket further comprising a second conductor set that includes spaced apart conductors mounted in said other one of said housings and respectively connected to said legs of said spring members.

16. The electrical socket of claim 15, wherein said shaft of said pivot member is hollow, said electrical socket further comprising two ground conductors respectively mounted in said housings, and an L-shaped conductive ground connecting member mounted in said shaft of said pivot member, and having opposite ends projecting through said shaft to interconnect said ground conductors.

17. The electrical socket of claim 16, wherein each of said housings has a peripheral side wall with a recessed face substantially parallel to said axis, said socket outlet opening at said recessed face.

18. The electrical socket of claim 17, wherein each of said housings further has a hinge adjacent to said recessed face, and a cover pivoted on said hinge for covering said recessed face.

19. The electrical socket of claim 14, further comprising a switch mounted on said other one of said housings and adapted to electrically connect an electric wire to said legs of said spring members mounted on said other one of said housings.

* * * * *